US011261754B2

(12) United States Patent
Patard et al.

(10) Patent No.: US 11,261,754 B2
(45) Date of Patent: Mar. 1, 2022

(54) SHELL FOR REDUCING OVERPRESSURE IN THE VICINITY OF THE UPSTREAM SEAL OF A TURBOJET BEARING HOUSING

(71) Applicant: SAFRAN AIRCRAFT ENGINES, Paris (FR)

(72) Inventors: Frédéric Patard, Saint Germain les Corbeil (FR); Antoine Jean-Philippe Beaujard, Melun (FR); Philippe Pierre Vincent Bouiller, Samoreau (FR); Christophe Caplain, Bondy (FR); Maxime Aurélien Rotenberg, Fresnes (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 141 days.

(21) Appl. No.: 16/483,464

(22) PCT Filed: Feb. 5, 2018

(86) PCT No.: PCT/FR2018/050274

§ 371 (c)(1),
(2) Date: Aug. 5, 2019

(87) PCT Pub. No.: WO2018/146404

PCT Pub. Date: Aug. 16, 2018

(65) Prior Publication Data

US 2020/0032672 A1 Jan. 30, 2020

(30) Foreign Application Priority Data

Feb. 7, 2017 (FR) ..... 17 00127

(51) Int. Cl.
*F01D 25/16* (2006.01)
*F01D 25/18* (2006.01)

(52) U.S. Cl.
CPC ..... *F01D 25/183* (2013.01); *F01D 25/16* (2013.01); *F05D 2230/60* (2013.01)

(58) Field of Classification Search
CPC ..... F01D 25/183; F01D 25/16; F05D 2230/60
See application file for complete search history.

(56) References Cited

U.S. PATENT DOCUMENTS 4,706,969 A * 11/1987 Mouri ..... F01D 11/003 277/362
5,301,957 A * 4/1994 Hwang ..... F16C 33/76 277/350

(Continued)

FOREIGN PATENT DOCUMENTS

CA 2813341 A1 10/2013
EP 2299092 A2 3/2011

OTHER PUBLICATIONS

Search Report issued in French Patent Application No. 17 00127 dated Nov. 30, 2017.

(Continued)

*Primary Examiner* — J. Todd Newton
*Assistant Examiner* — Theodore C Ribadeneyra
(74) *Attorney, Agent, or Firm* — Pearne & Gordon LLP

(57) ABSTRACT

The invention relates to a turbojet bearing housing including a fixed envelope traversed by a rotor, this envelope including a cylindrical end surrounding a seal ensuring the leak tightness of the cylindrical end of the envelope with the rotor, this envelope being equipped with a shell screwed onto the cylindrical end thereof, this shell including radial channels emerging opposite the seal while being arranged so that an air stream traversing the seal towards the housing mainly comes from these radial channels.

5 Claims, 3 Drawing Sheets

(56) References Cited

U.S. PATENT DOCUMENTS 5,593,165 A * 1/1997 Murray ..... F01D 11/003 277/543
6,142,729 A * 11/2000 Tran ..... F01D 11/003 415/113
6,609,888 B1 * 8/2003 Ingistov ..... F01D 11/005 415/113
9,759,093 B2 9/2017 Donaldson et al.
9,944,399 B2 * 4/2018 Desjardins ..... B64D 27/10
10,781,709 B2 * 9/2020 Sen ..... F01D 25/12
2007/0085278 A1 * 4/2007 Davis ..... F01D 25/183 277/411
2007/0193276 A1 * 8/2007 Corattiyil ..... F02C 7/06 60/782
2007/0253809 A1 * 11/2007 Glynn ..... F01D 11/04 415/174.2
2011/0049809 A1 * 3/2011 Garrison ..... F01D 25/183 277/304
2012/0248707 A1 * 10/2012 Dixon ..... F01D 11/04 277/412
2013/0142679 A1 * 6/2013 Hornbach ..... F01D 25/183 417/406
2013/0192253 A1 * 8/2013 Ackermann ..... F01D 5/085 60/782
2013/0241153 A1 * 9/2013 Garrison ..... F16J 15/40 277/350
2014/0099188 A1 * 4/2014 Bordne ..... F01D 25/183 415/112
2014/0265145 A1 * 9/2014 Copeland, III ..... F16J 15/3496 277/405
2015/0184531 A1 * 7/2015 Baptista ..... F01D 25/16 415/230
2016/0341059 A1 * 11/2016 Bioud ..... F01D 25/183
2016/0363224 A1 * 12/2016 Deterre ..... F01D 25/16
2017/0067397 A1 * 3/2017 Fang ..... F16C 33/664
2017/0107854 A1 * 4/2017 Friedl ..... F01D 25/125
2017/0152754 A1 * 6/2017 Leutard ..... F01D 25/186

OTHER PUBLICATIONS

International Search Report issued in Application No. PCT/FR2018/050274 dated May 8, 2018.
Written Opinion issued in Application No. PCT/FR2018/050274 dated May 8, 2018.

* cited by examiner

SHELL FOR REDUCING OVERPRESSURE IN THE VICINITY OF THE UPSTREAM SEAL OF A TURBOJET BEARING HOUSING

This is the National Stage application of PCT international application PCT/FR2018/050274, filed on Feb. 5, 2018 entitled "CASING FOR REDUCING OVERPRESSURE IN THE VICINITY OF THE UPSTREAM JOINT OF A TURBOJET BEARING HOUSING", which claims the priority of French Patent Application No. 17 00127 filed Feb. 7, 2017, both of which are incorporated herein by reference in their entirety.

TECHNICAL FIELD

The invention relates to pressure balancing in the vicinity of an inner housing containing a lubricated bearing in a turbojet type aircraft engine.

PRIOR ART

A turbojet typically includes, from upstream to downstream in the direction of the air flow, a low pressure compressor, a high pressure compressor, a combustion chamber, followed by a high pressure turbine and a low pressure turbine.

In the case of a double body turbojet, the high pressure compressor and the high pressure turbine form part of a so-called high pressure rotating body that surrounds a low pressure shaft while turning at a different speed thereto. The low pressure shaft bears for its part the low pressure compressor and the low pressure turbine.

The low pressure shaft and the high pressure body are borne upstream and downstream by bearings housed in housings isolating them from the remainder of the engine. Each housing contains a bearing in the form of one or more roller bearings interposed between a rotating element such as the shaft or the high pressure body, and a fixed element of the engine.

Each bearing is lubricated by oil circulating in the housing that surrounds it, this housing being delimited by fixed structural elements of the engine and by the rotating element that traverses it.

More generally, such a housing contains at least one bearing while being delimited by walls that turn with respect to each other with a seal between these walls, which limits the leakage section of the housing. Oil is kept away from the seal by means of an air knife permanently entering through this seal, from the outside to the inside of the housing.

In the present case, an upstream seal is provided to constitute a barrier at the junction of the fixed parts delimiting the upstream housing with the rotating element, and a downstream seal is provided to form another barrier at the junction of the fixed parts downstream of the housing with the rotating element. Thanks to the air knife continually entering into each seal, the housing makes it possible to circumscribe the oil so that it remains in the vicinity of the bearing without risk that it pollutes the remainder of the engine.

Complementarily, air is extracted outside of the housing via an oil recovery circuit which is controlled by a volume pump pumping both air and oil.

In operation, the pressure reigning in the housing is lower than the pressure surrounding the housing, to avoid the oil escaping, because this oil is capable of igniting in the hotter parts of the turbojet, which could lead to its deterioration. It is this pressure difference that ensures that air continually enters into the housing through the seals, and it is continually extracted by the pump which thereby controls the flow rate of air traversing the housing.

In such an arrangement, an equilibrium is necessary between the difference in pressure at the upstream seal and the difference in pressure at the downstream seal. If the pressure difference at one of the seals is more important than the pressure difference at the other seal, then only one of the seals is traversed by an air knife, such that an oil leak may occur through the other seal.

Thus, in the event of overpressure upstream of the upstream seal compared to the pressure downstream of the downstream seal, this pressure difference tends to make air leak outside of the housing via the downstream seal.

In practice, the upstream seal has a diameter significantly greater than the downstream seal. Since the air arriving in rotor contact in the vicinity of a seal is rotated by this rotor, it undergoes a so-called vortex effect which tends to establish a radial pressure gradient. It follows that the pressure upstream of the upstream seal is greater than the pressure downstream of the downstream seal, the so-called vortex effect being less important around the downstream seal due to the fact that its diameter is significantly smaller.

In patent application FR301661 it is provided for this purpose to fix to the fixed envelope, around the upstream seal, a plate spaced apart from the seal along the longitudinal axis, and comprising radial fins delimiting as many radial channels. This arrangement makes it possible to cancel out the vortex effect at the level of the upstream seal, and hence to cancel out the pressure difference between the upstream and downstream seals.

In practice, it turns out that the mounting of this plate and its adjustment are complex and expensive.

The subject matter of the invention is to provide an arrangement making it possible to decrease the pressure in the immediate external environment of the upstream seal, with simple and precise mounting.

DESCRIPTION OF THE INVENTION

To this end, the subject matter of the invention is a turbojet bearing housing including a fixed envelope traversed by a rotor, this envelope including a cylindrical end surrounding a seal ensuring the leak tightness of the cylindrical end with the rotor, this envelope being equipped with a shell screwed onto its cylindrical end, this shell including radial channels emerging opposite the seal while being arranged so that an air stream traversing the seal towards the housing mainly comes from these radial channels.

With this arrangement, the mounting of the shell is achieved mainly by screwing around the end of the envelope, that is to say by addition of a limited number of components being positioned necessarily in a precise manner with respect to the seal.

The invention also relates to a housing thereby defined, including a locking collar surrounding the shell and including on the one hand tabs engaging in corresponding notches of the envelope and on the other hand tabs pulling down into corresponding notches of the shell to rotationally lock this shell with respect to the envelope.

The invention also relates to a housing thereby defined, in which the rotor comprises in the vicinity of the seal a drop throwing device situated opposite an inner face of the shell to centrifuge the oil present on the rotor in the event of leakage of the seal.

The invention also relates to a housing thereby defined, in which the shell comprises a drainage sheet to collect the oil centrifuged by the drop throwing device.

The invention also relates to a housing thereby defined, in which the seal is maintained axially locked in the cylindrical end of the envelope by the shell.

The invention also relates to a method for mounting a shell equipping a housing thereby defined, including:

- a step of positioning the collar at the level of the cylindrical end of the envelope;
- a step of docking the shell between this collar and the cylindrical end of the envelope by screwing an inner threading of the shell onto an outer threading of the cylindrical end;
- a step of tightening the shell until frontal notches of this shell are placed in correspondence with upstream tabs of the collar;
- a step of pulling down the upstream tabs into the frontal notches.

The invention also relates to a method for mounting a shell equipping a housing thereby defined, including:

- a step of docking the shell bearing the collar by screwing an inner threading of the shell onto an outer threading of the cylindrical end;
- a step of tightening the shell until frontal notches of this shell are placed in correspondence with upstream tabs of the collar;
- a step of pulling down the upstream tabs into the frontal notches.

The invention also relates to a turbomachine including a bearing housing thereby defined.

The invention also relates to a turbojet including a turbomachine thereby defined.

DETAILED DESCRIPTION OF PARTICULAR EMBODIMENTS

Figure 1:
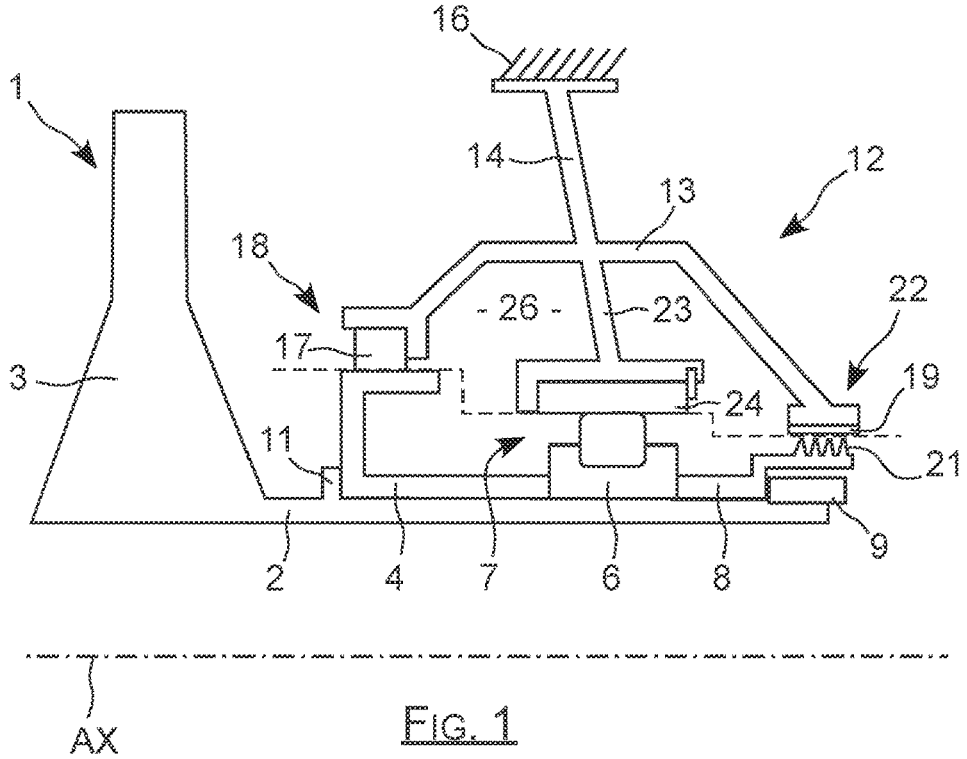
FIG. 1 is a schematic sectional half-view showing the assembled rotor and stator elements of a turbojet at the level of a high pressure body rear bearing with its lubrication housing.

In FIG. 1, a rear portion 1 of a high pressure body comprises a rotor trunnion 2 which bears from upstream to downstream a high pressure turbine disc 3, a rotor element 4 inside the upstream seal, an inner collar 6 of a roller bearing 7, a tongue holder 8 and a terminal nut 9. The terminal nut 9 maintains in position, along the axis of rotation AX of this high pressure body, the rotor 4, the collar 6 and the tongue holder 8 which are thereby tightened between an outer shoulder 11 of the trunnion 2 situated immediately downstream of the turbine disc 3, and this terminal nut 9 which is at the end of the high pressure body.

This high pressure body rear portion 1 is surrounded by a fixed casing 12, which is here a so-called inter-turbine casing, that is to say situated along the axis AX between the high pressure turbine 3 and a low pressure turbine not represented in the figure.

This casing 12 comprises an envelope 13 that globally surrounds the inner element 4 of the upstream seal, the bearing 7 and the tongue holder 8, this envelope 13 being connected by a radial structure 14 to a fixed structural element 16 of the engine.

The upstream end of this envelope 13 receives a circumferential element 17 of the upstream seal that surrounds the inner element 4, to constitute jointly the upstream seal 18. It bears at its downstream end a collar 19 made of abradable material that surrounds the tongues 21 of the tongue holder 8 to constitute therewith the downstream seal 22.

In the example of the figures, the upstream seal is a segmented radial seal, and the downstream seal is a labyrinth type seal, including circumferential tongues of which the radial ends run along the inner face of the abradable collar 19.

Other configurations are possible, the segmented radial seal and the labyrinth seal being able to be inversed; a segmented radial seal or a labyrinth seal being able to be mounted at each seal; at least one of the seals being able to be a floating collar seal.

The bearing further comprises, at mid distance between the ends of the envelope, an inner structure 23 bearing an outer collar 24 of the roller bearing 7, this structure 23 extending radially towards the inside of the envelope 13.

The envelope 13 with its upstream and downstream seals 18 and 22 surrounds the trunnion 2 to delimit therewith the housing 26 which surrounds the bearing 7 to ensure its lubrication.

Figure 2:
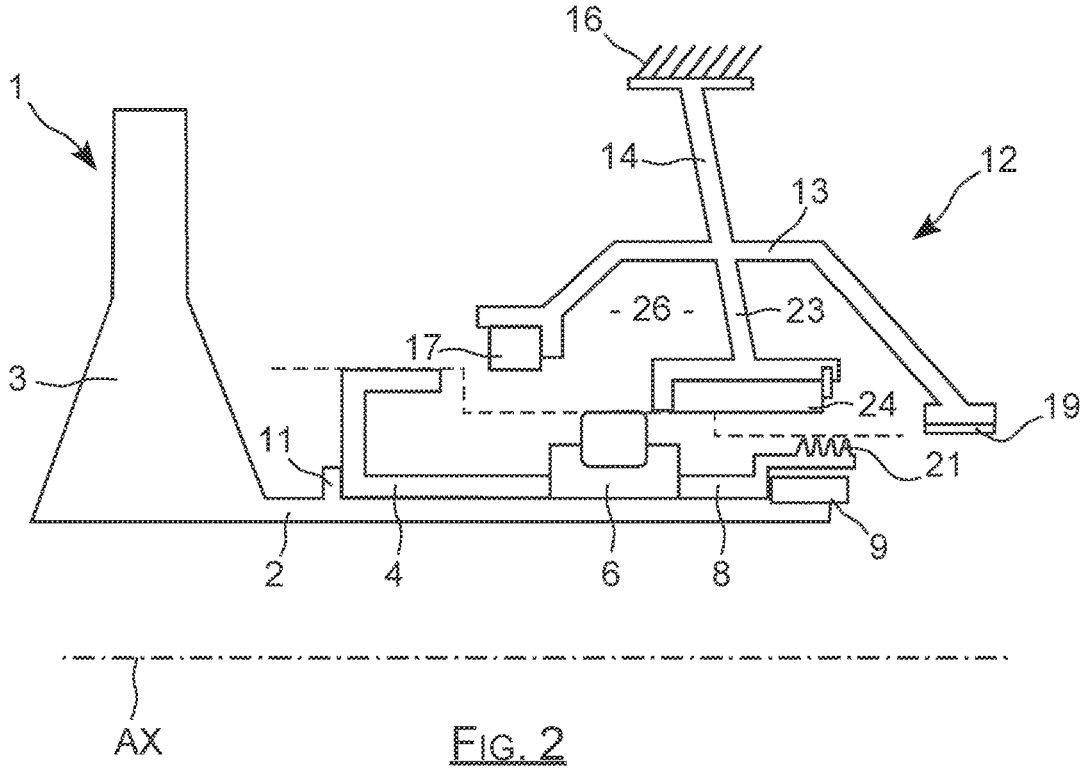
FIG. 2 is a schematic sectional half-view showing the rotor and stator elements in the course of assembly of a turbojet at the level of a high pressure body rear bearing with its lubrication housing.

As illustrated schematically in FIG. 2, it is important to note that for mounting reasons, the diameters of the rotor 2, 3 and of the envelope 13 are increasing, here from downstream to upstream. Thus, in the example of the figures, the diameters of the rotor and of the envelope at the level of the upstream seal 18 are greater than the diameters of the rotor and of the envelope at the level of the bearing 6, which are themselves greater than the diameters of the rotor and of the envelope at the level of the downstream seal 22.

This increase in diameter, also called staircase dimensioning, enables the engagement of the rotor in the stator, as schematically represented in FIG. 2. The rotor is thereby engaged in the stator while being displaced from upstream to downstream, without interference thanks to the fact that the diameters are decreasing from upstream to downstream.

It follows that in such an arrangement, the upstream and downstream seals necessarily have significantly different diameters, such that the pressure around these seals is necessarily different given the vortex effect. In the example of the figures, the upstream seal 18 thus has a diameter much greater than the downstream seal 22, such that it undergoes an external pressure greater than the external pressure of the downstream seal.

Figure 3:
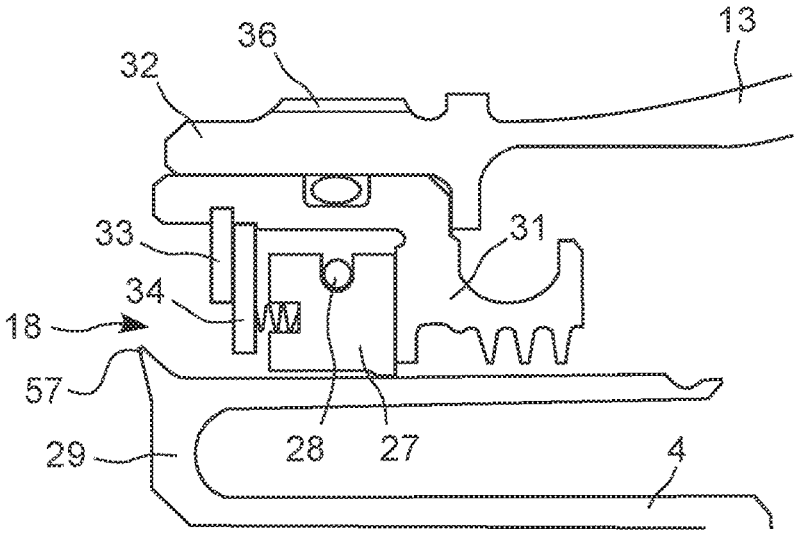
FIG. 3 is a sectional half-view of an upstream seal of a lubrication housing.

Given its large diameter, the upstream seal is here a segmented radial seal of which the structure appears more clearly in FIG. 3, this upstream seal 18 corresponds to that described in the patent document EP1055848. It comprises a ring of segments 27 maintained together by a circumferential spring 28 and surrounding an upstream end 29 of the inner element 4 of the rotor. The sealing is formed at the level of the rotating sliding contact establishing itself between the outer face of the rotating end 29, and the inner face of the fixed ring of segments 27 which surrounds this rotating end 29.

The ring 27 is maintained in a fixed support 31 which is fitted into and maintained in an upstream cylindrical end 32 of the envelope 13. This support 31 comprises a cylindrical inner face extended by an inner shoulder delimiting a flat face against which is bearing the ring 27. A stop ring 33 forming an inner circling is engaged and locked in an inner groove of the cylindrical face of the support 31, at a distance from its shoulder face.

The ring 27 bears an additional crown 34 to which it is connected by axial springs, to constitute an assembly extending along the axis AX between the stop ring 33 and the shoulder. Thanks to the axial springs, the segment 27 is maintained pressed against the shoulder of the support 31, the additional crown 34 bearing against the stop ring 33, as may be seen in FIGS. 3 to 5.

Figure 6:
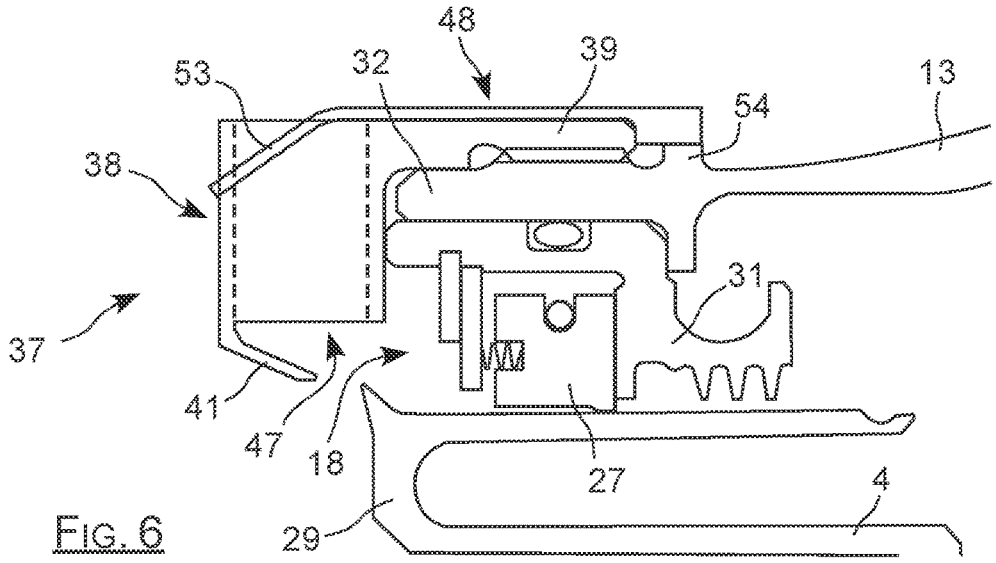
FIG. 6 is a sectional half-view of an upstream seal of a lubrication housing equipped with a shell according to the invention.

As may be seen in FIG. 3, the upstream cylindrical end 32 of the envelope 13 comprises on its outer face a threading marked by 36, intended to receive a shell 37 having a general crown shape, as may be seen in FIG. 6.

This shell 37, seen in section along a plane passing through its axis of revolution AX, comprises a body 38 extended along the axis AX by a tapped cylindrical collar 39, and extended inwards by a conical wall 41.

Figure 4:
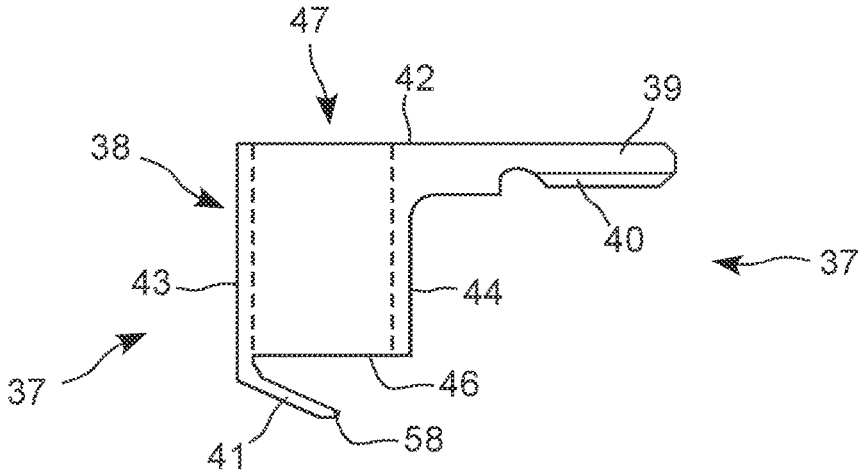
FIG. 4 is a sectional view showing in detail the shape of the section of the shell according to the invention.
Figure 5:
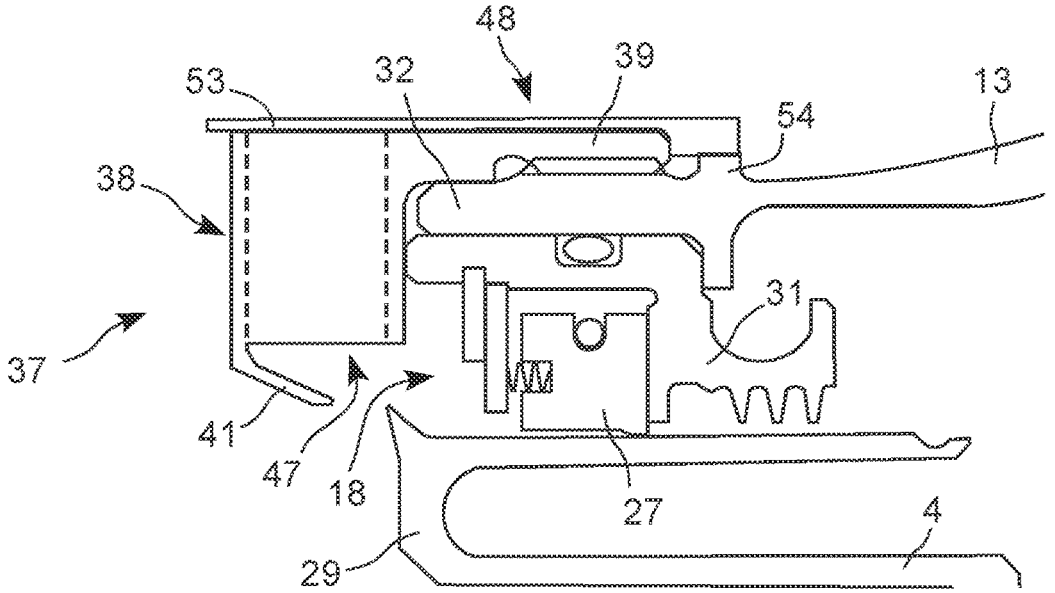
FIG. 5 is a sectional half-view of an upstream seal of a lubrication housing in the course of mounting a shell according to the invention.

As may be seen in FIG. 4, the body 38 has a rectangular contour delimiting in particular an outer radially cylindrical face 42 which is extended by the collar 39, and a flat frontal face 43, of orientation normal to the axis AX, of which the wall 41 constitutes an extension. This body also delimits a flat downstream face 44 parallel to the frontal face 43, and a radially inner face 46.

The wall 41 starts from the edge uniting the faces 43 and 46, it has a conicity of the order of thirty degrees, and it extends opposite the inner face 46 to extend over around half of the length of this face 46 along the axis AX.

Figure 8:
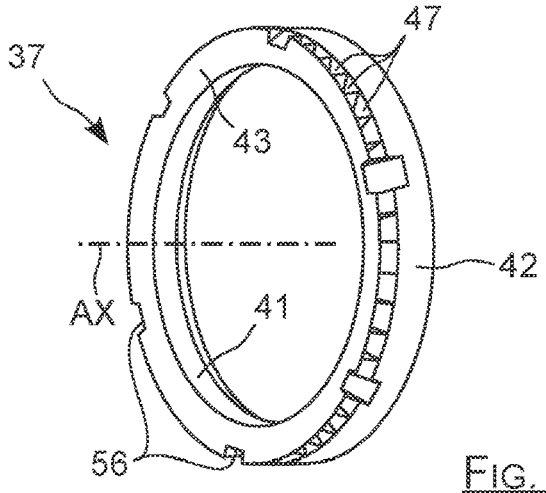
FIG. 8 is a perspective view of a shell represented alone in accordance with the invention.

As may be seen more clearly in FIG. 8, the crown-shaped body 38 is traversed by a series of radial channels, marked by 47 adjacent to one another, and each placing in communication the outer face 42 with the inner face 46.

Figure 7:
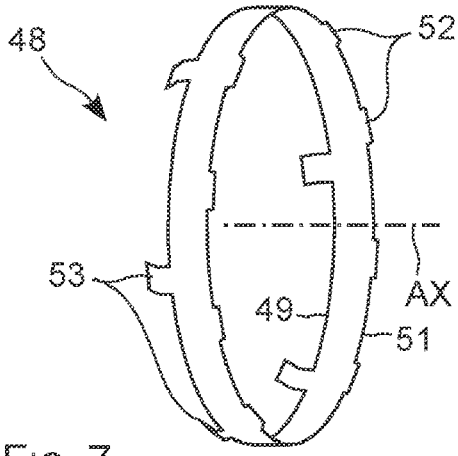
FIG. 7 is a perspective view of a locking collar represented alone for the shell in accordance with the invention.

When it is mounted, this shell 37 is maintained tightened on the end 32 by a locking collar made of metal sheet 48 which appears alone in FIG. 7. This locking collar 48 has for its part a general ring shape comprising an upstream edge 49 and a downstream edge 51, with here eight downstream tabs 52 extending beyond its downstream edge, and six upstream tabs 53 extending beyond its upstream edge, all these tabs being regularly spaced apart around the axis of revolution AX. Generally speaking, the collar comprises at least two downstream tabs and at least two upstream tabs.

Complementarily, the envelope 13 comprises a circumferential edge 54 situated opposite the collar 39 when the shell is mounted, that is to say set back with respect to the end 32, and which comprises eight notches not visible in the figures and each intended to receive one of the downstream tabs 52.

In an analogous manner, the shell 37 comprises at least two notches, here six notches marked by 56 which are each intended to receive one of the upstream tabs 53, the number of notches being identical to the number of tabs. Each notch 56 is formed at the level of the edge uniting the frontal face 43 and the outer radial face 42 of this shell, each notch being situated between two radial channels 47, and also enabling the tightening of the shell with an appropriate tightening tool.

The locking collar 48 has an inner diameter corresponding to the diameter of the outer radial face 42 of the shell, so as to surround it when the assembly is in place as in FIG. 6.

Figure 9:
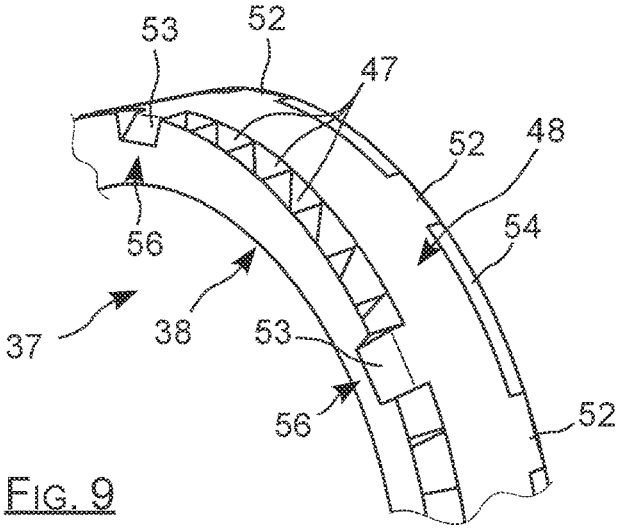
FIG. 9 is a partial view showing a shell equipped with its locking collar in accordance with the invention.

The mounting of the assembly may consist in installing the collar 48 in position at the level of the cylindrical end 32 of the envelope 13, the tabs 53 then being flat. The shell 37 is then docked between this collar 48 and the envelope 13 by screwing the inner threading 40 of this shell around the outer threading 36 of the end 32. Once the shell is pressed down, while having its face 44 bearing on an upstream end of the support 31, it is tightened until its frontal notches 56 are placed opposite upstream tabs 53. The tabs 53 may then be folded back towards the axis AX to be pulled down into the notches 56, so as to completely rotationally lock the shell 37 with respect to the end 32 on which it is tightened, which corresponds to the situation of FIGS. 6 and 9.

This mounting requires mounting the shell 37 between the end 32 and the collar 48 with low bulk and low alignment tolerances, but the collar and the shell are mounted with respect to the casing.

Another possibility is to mount the collar 48 around the shell 37, to screw the shell onto the end 32. When the shell is pressed down, while having its face 44 bearing on an upstream end of the support 31, it is tightened until its frontal notches 56 are placed opposite upstream tabs 53. The upstream tabs 53 may then be pulled down to ensure complete locking.

This mounting requires the handling of a sub-assembly formed by the shell and the non-integral collar, but is simpler in docking.

In this arrangement, the shell 37 covers the upstream edge of the end 32 while extending radially towards the axis AX to cover radially the majority of the seal 18. In concrete terms, the inner diameter of this shell 37, corresponding to the inner diameter of the wall 41, is very slightly greater than the outer diameter of the rotating end 29 in order to enable the mounting of this shell 37.

To this end, the rotating end 29 comprises a terminal edge 57 extending radially into a tip, and of which the outer diameter is slightly less than the diameter of the free edge 58 of the wall 41, while being situated at a short distance from this free edge 58 along the axis AX.

The annular space situated between the terminal edge 57 and the free edge 58 which constitutes an air passage to the seal 18 is thus provided very small radially and axially, so as to limit the flow rate through this passage.

Conversely, the radial channels 47 have important passage sections so that the passage of air to the seal 18 takes place mainly via these radial channels, that is to say without undergoing a vortex effect and hence without pressure increase.

Furthermore, the terminal edge 57 of the rotor ends in a tip oriented radially outwards to constitute a drop throwing device making it possible to avoid a dispersion of oil in the air stream, in the event of an oil leak from the housing 26 through the upstream seal 18.

More specifically, in the event of total or partial failure of the seal 18, a drop of oil running along the outer face of the rotor in the direction of the end 29 of this rotor encounters the drop throwing device 57 which constitutes a radial protuberance in its path. Given the high rotational speed of the rotor, this drop is then centrifuged by the drop throwing device 57, such that it leaves the rotor to re-join the inner face 46 of the shell 37 and the conical wall 41 which constitutes a drainage sheet, which are immobile with the stator.

At this stage, the drop of oil can stream along the inner face 46 to reach the bottom of the shell and next a lower part of the engine which makes it possible to drain it. In the case of a drop of oil centrifuged in the upper part of the inner face 46 it may, if needs be, be detached from this inner face to the rotor to be again centrifuged, such that it ultimately reaches the lower part of the shell and the engine to be drained therefrom.

The drop throwing device 57 thus makes it possible to confine the oil generated by a leakage of the seal 18 in the region of the shell 37 to finally drain it, so as to avoid and at the least to limit a dispersion of this oil in the air stream passing through the engine.

Complementarily, an additional casing borne by the rotor may be provided to cover frontally the shell 37 and the seal, while extending to surround them, so as to limit further the risks of dispersion of oil to the air stream.

What is claimed is:

1. A turbojet bearing housing including a fixed envelope traversed by a rotor, the envelope including a cylindrical end having an outer threading surrounding a seal ensuring a leak tightness of the cylindrical end with the rotor, the envelope being equipped with a shell having an inner threading screwed around the outer threading of the cylindrical end of the envelope, the shell including radial channels emerging opposite the seal while being arranged so that an air stream traversing the seal towards the housing mainly comes from these radial channels in which the seal is maintained axially locked in the cylindrical end of the envelope by the shell; and the turbojet bearing housing further including a locking collar surrounding the shell, the locking collar including on the one hand tabs engaging in corresponding notches of the envelope and on the other hand tabs pulling down into corresponding notches of the shell to rotationally lock the shell with respect to the envelope.

2. The turbojet bearing housing according to claim 1, in which the rotor comprises in the vicinity of the seal a drop throwing device situated opposite an inner face of the shell to centrifuge oil present on the rotor in the event of leakage of the seal.

3. The turbojet bearing housing according to claim 2, in which the shell comprises a drainage sheet to collect the oil centrifuged by the drop throwing device.

4. A turbomachine including the turbojet bearing housing according to claim 1.

5. A turbojet including the turbomachine according to claim 4.

* * * * *